United States Patent [19]

Shaw

[11] Patent Number: 4,926,911

[45] Date of Patent: May 22, 1990

[54] DETECTION AND STANDBY WEFT SUPPLY APPARATUS BREAK

[75] Inventor: Henry Shaw, Woesten-Vleteren, Belgium

[73] Assignee: Picanol N.V., Belgium

[21] Appl. No.: 324,000

[22] Filed: Mar. 16, 1989

[30] Foreign Application Priority Data

Mar. 16, 1988 [BE] Belgium ..... 8800300

[51] Int. Cl.[5] ..... D03D 47/34; D03D 51/34

[52] U.S. Cl. ..... 139/435.1; 139/450; 139/370.2

[58] Field of Search ..... 139/435, 450, 452, 370.2

[56] References Cited

U.S. PATENT DOCUMENTS

| | | | |
|---|---|---|---|
| 4,215,728 | 8/1980 | Weidman et al. . | |
| 4,573,499 | 3/1986 | Sugita et al. | 139/370.2 |
| 4,617,971 | 10/1986 | Hellstroem . | |
| 4,815,501 | 3/1989 | Takehana | 139/450 X |
| 4,832,086 | 5/1989 | Shin et al. | 139/435 |
| 4,832,091 | 5/1989 | Shaw | 139/450 |

FOREIGN PATENT DOCUMENTS

| | | |
|---|---|---|
| 901969 | 9/1985 | Belgium . |
| 2908743 | 9/1979 | Fed. Rep. of Germany . |
| 0094099 | 11/1983 | Fed. Rep. of Germany . |
| 0195469 | 9/1986 | France . |

*Primary Examiner*—Andrew M. Falik

*Attorney, Agent, or Firm*—Bacon & Thomas

[57] ABSTRACT

An airjet weaving machine weft thread supply includes at least two thread preparation mechanisms and detectors for detecting thread breaks. When the detectors detect a thread break, a control unit deactivates the thread preparation mechanism in which the thread break has occurred and transfers the task of the deactivated thread preparation mechanism to another thread preparation mechanism. The control unit also activates an alarm signalling system and may also cause the main drive of the weaving machine to shut off in response to detection of a thread break.

8 Claims, 1 Drawing Sheet

1
2
3
5
5
24
23

2
10
9
8
4
21
5
17
32
6
20
19
18
10A
20
33
16
6
19
32
33
3
11
8
4
21
17
16
18
5
24
30
30
31
26
7
28
29
7
31
28
27
22
12
25
13
14
15
23

DETECTION AND STANDBY WEFT SUPPLY APPARATUS BREAK

BACKGROUND OF THE INVENTION

This invention concerns an airjet weaving machine with an improved weft thread supply.

It is known that the supply of weft threads on an airjet weaving machine normally consists of several thread preparation mechanisms each made up of at least one thread package, a thread accumulator device such as for example a prewinder, a thread stopping device in order to release suitable lengths of weft thread from the prewinder, and a main nozzle.

Clearly, the various thread preparation mechanisms can work with various types of weft thread, for example in order to weave with several colors.

From Belgian Pat. No. 901.696 it is known to double the number of thread preparation mechanisms. In front of each thread preparation mechanism is placed a thread detector connected to a control unit, such that whenever a broken weft thread is detected in one thread preparation mechanism, the system automatically switches over to the other thread preparation mechanism, enabling weaving to continue without interruption.

The main nozzle of the thread preparation mechanism which is switched off remains in operation, normally at a low flow rate, so that the section of weft thread between the thread stopping device and the main nozzle remains tensioned, otherwise this section of weft thread would fall out of the main nozzle and become entangled in the other weft threads.

When the thread preparation mechanism is switched to standby, the weaver has to intervene in order to repair the defective supply channel. However, it may happen that said section of weft thread has to wait in the main nozzle for too long. The main nozzle is normally mounted on the sley of the weaving machine and so performs a back-and-forth motion, with the result that the section of thread extending into the main nozzle is subject to a heavy load and may break.

If the section of weft thread breaks close to the main nozzle on standby, the piece of thread which comes loose may be blown into the shed along with a weft thread from another main nozzle, so causing a weaving defect which greatly impairs the quality of the woven article.

If said weft thread breaks close to the thread accumulator device, there is a high chance that the piece of thread broken off will become entangled with the other weft threads, in which case either it may be blown along with them into the shed by another main nozzle, or it may block the other main nozzles. In the latter case a weaving machine stop will occur which may last relatively long, since the weaver normally cannot attend to the machine immediately.

SUMMARY OF THE INVENTION

The purpose of the invention is to offer a solution to the above-mentioned disadvantages, by among other things, instead of waiting until a thread break occurs, giving a signal to the weaver, followed a little while later by an automatic machine stop and/or appropriate alarm signal.

The signal enables the weaver to intervene quickly, while in the extreme case the machine stop prevents a weaving fault occurring as a result of a loose piece of thread being blown into the shed.

The invention also concerns an airjet weaving machine including the following at least two thread preparation mechanisms, each of which has at least one thread package, one weft accumulator device, one thread stopping device and one main nozzle; detectors mounted between the corresponding thread package and the corresponding thread stopping device and which operate on at least one of the weft threads, in order to detect thread breaks; a control unit connected to the detectors and to the thread preparation mechanisms, and which if the detector detects a thread break, deactivates the thread preparation mechanism in which the thread break occurs and transfers its task to another thread preparation mechanism; and a monitoring device connected to the detector and which includes at least a delay circuit which provides an output signal for further processing after a certain time from the moment that the detector detects a thread break.

The airjet weaving machine is preferrably equipped with an alarm signalling system which is activated whenever said detector detects a thread break. The delay circuit is preferably connected to the main drive of the weaving machine, such that said output signal results in the main drive being shut off.

Preferably, other thread detectors should be mounted near the main nozzles in order to monitor the presence of the weft thread. Whenever a thread break nevertheless occurs in a main nozzle on standby, so that a piece of thread escapes and can get into the shed, the corresponding thread detector—which does not detect a thread any more—emits a signal, with the result that the main drive of the weaving machine is immediately shut off.

BRIEF DESCRIPTION OF THE DRAWINGS

In order to better explain the characteristics of the invention, the following preferred embodiment is described, by way of example only and without being limitative in any way, with reference to the accompanying drawings, where.

DESCRIPTION OF THE PREFERRED EMBODIMENT

Figure 1:
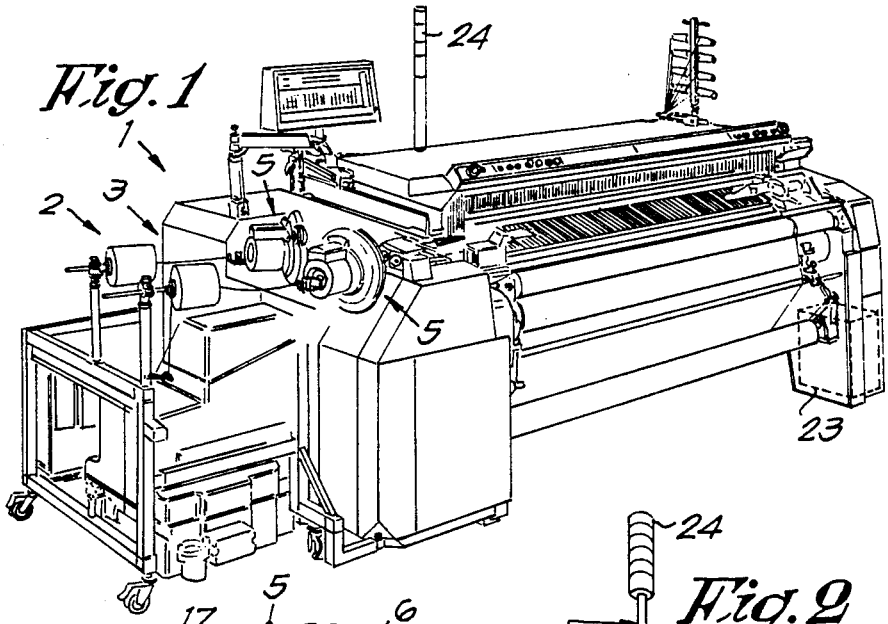
FIG. 1 is a perspective view of an airjet weaving machine equipped with a weft thread supply according to the invention.

FIG. 1 represents an airjet weaving machine showing schematically the supply 1 according to the invention.

Figure 2:
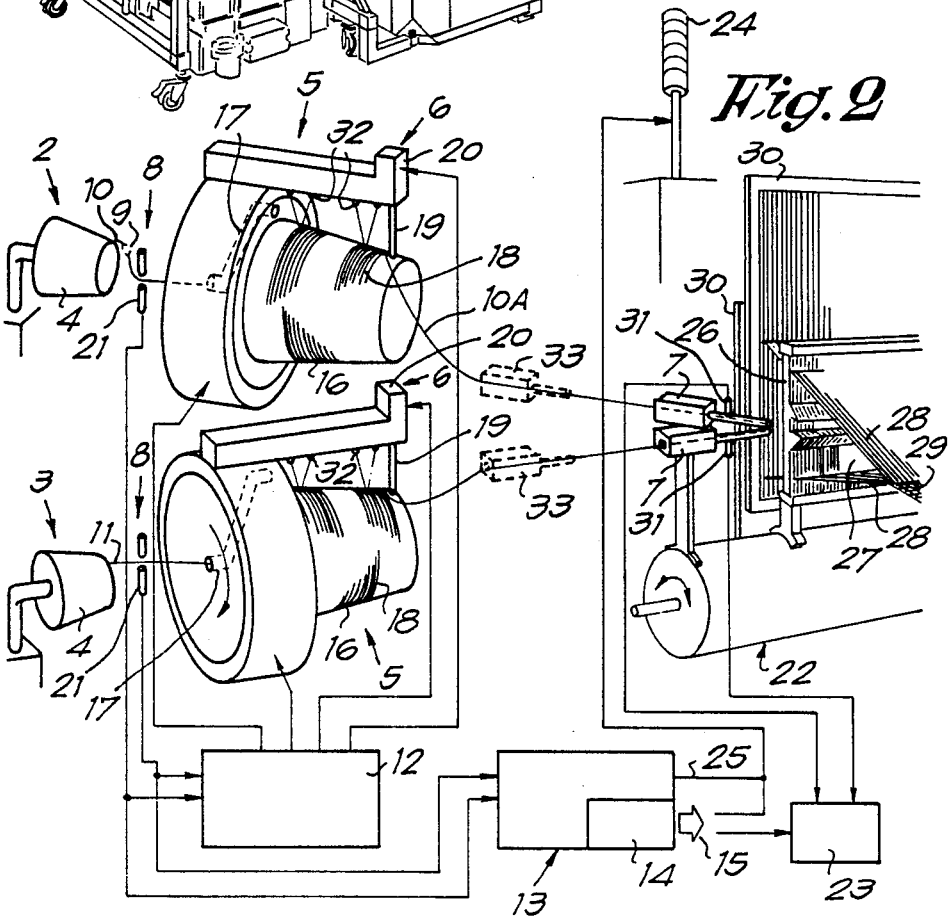
FIG. 2 is a schematic representation including perspective views of the weft thread supply according to the invention.

As shown in FIG. 2, the supply 1 includes at least two thread preparation mechanisms 2 and 3, each of which is made up of at least one thread package 4, a thread accumulator device such as for example a prewinder 5, and thread stopping device 6 and a main nozzle 7. The supply 1 according to the invention also includes detectors 8 for detecting thread breaks 9, where said detectors operate on at least one of the weft threads 10 and/or 11 of the respective thread packages 4; a control unit 12 which is connected to the detectors 8 and to the thread preparation mechanisms 2 and 3—more specifically the prewinder 5, which if the detectors 8 detect a thread break 9 deactivates the thread preparation mechanism in which the thread break 9 occurs and transfers its task to the other thread preparation mechanism; and a monitoring device 13 connected to the detectors 8 and consisting of at least a delay circuit 14 which supplies an output signal 15 for further processing at a certain time after the detectors 8 have detected a thread break 9.

In the embodiment shown in FIG. 2, the prewinders 5 include respectively a fixed winding drum 16 and a rotating winding tube 17 in order to wind turns of the thread 18 onto the winding drum 16.

The thread stopping devices 6 as is known each include a pin 19 which can move up and down and which operates on the corresponding winding drum 16 and which can be positioned by means of an electromagnetic drive 20.

The detectors 8 consist of thread break detectors 21 mounted in the path of the weft threads 10 and 11, more particularly between the thread packages 4 and the respective thread stopping devices 6. The optimum position is at the entrance of the winding tube 17.

The abovementioned main nozzles 7 are normally mounted on the sley 22 and carry out a back-and-forth motion.

The monitoring devices 13 as shown in FIG. 2 are coupled, via the delay circuit 14, to the main drive 23 of the weaving machine and/or an alarm signalling system 24, consisting for example of a light tree. There is also a direct connection 25 between the monitoring device 13 and the alarm signalling system 24.

For the sake of clarity, FIG. 2 also shows the reed 26, the shed 27, the warp threads 28, the woven article 29 and the harnesses 30.

Finally, detectors 31 are mounted as far downstream as possible along the path of the thread in the thread preparation mechanisms 2 and 3. Said detectors 31 preferably operate on the thread guide channels of the main nozzles 7, or are mounted just after the outlets of the main nozzles 7. Whenever one of these detectors 31 ceases to detect one of the weft threads 10 and/or 11, it supplies a signal which results in the main drive 23 being shut off. The detectors 31 can be either connected directly to the main drive 23, as shown in FIG. 2, or may be connected to it indirectly, for example by means of the monitoring device 13.

The operation of the supply 1 is now described for a thread break 9 which has occurred in the weft thread 10. The thread break is detected by the thread break detector 21 of the thread preparation mechanism 2. As a result, the control unit 12 is activated, so that the thread preparation mechanism 2 is deactivated and its task, i.e., supply of weft threads to the main nozzle 7, is taken over by the thread preparation mechanism 3. Concomitantly, the drive of the winding tube arm 17 of the prewinder 5 of the thread preparation mechanism 2 is deactivated, while the corresponding pin is kept in the closed position.

The main nozzle 7 of the thread preparation mechanism 2 remains active at a low flow rate so that the section of weft thread 10A between said main nozzle 7 and the corresponding thread stopping device 6 remains stretched. As a result of the back-and-forth motion of this main nozzle 7 and the tensioning force permanently exerted on the weft thread 10, said section of weft thread 10A will usually break off after a certain time, with the chance that it will either be woven in or become entangled in the other weft thread 11.

According to the invention, a solution to this is provided by the detectors activating the monitoring device 13 at the moment a thread break 9 is detected, such that after a certain time an output signal 15 is supplied by the delay circuit 14, with the result than an alarm operates on the signalling system 24 and/or the main drive 23 of the weaving machine is shut off.

In the preferred embodiment, at the moment the thread break 9 is detected a flashing lamp on the signalling system 24 is activated via a connection 25 and switches slowly on and off. When, however, the time interval set on the delay circuit 14 has expired, the lamp is switched on continuously by means of the output signal 15, and the weaving machine is stopped. The lamp can for instance flash faster and faster as the time interval on the delay circuit passes.

According to the signalling, the weaver knows how urgently a repair has to be made.

Clearly, the delay circuit 14 can be reset by the weaver as soon as he reaches the corresponding machine. At that moment he can carry out a repair, without the main drive of the weaving machine having to be shut off.

The delay setting is preferably variable, and is chosen so that on the one hand the weaver has a suitable amount of time to intervene before the weaving machine stops automatically, and on the other the delay is not longer than the period in which there is a chance of a break occurring in the corresponding section of weft thread 10A. The delay setting is preferably determined empirically, by determining the time after which thread breaks normally occur. This will of course depend on the quality and type of weft threads used.

It can happen that in the section of weft thread 10A in the main nozzle on standby, there may be a weak piece of thread between the pin 19 and the corresponding main nozzle 7 which is weaker than the average strength of the thread. In this special case there is a high chance of the section of weft thread 10A breaking between the pin 19 and the main nozzle 7 before the set time interval has expired, with the result that a weaving fault arises unnoticed by the weaver.

In order to make it possible to intervene in case of such faults, use is preferably made of the abovementioned detectors 31. Whenever an unexpected break does occur prematurely the main drive 23 is immediately shut off. The weaver must repair the fault and restart the machine. In such a case a distinctive signal can be given, so that the weaver can carry out the repair and restart this weaving machine first, with the aim of leaving as few as possible machines in the weaving mill idle.

In this invention, by temporarily stopping the main drive 23 of the weaving machine, a great number of weaving faults can be avoided, thus enabling significantly higher quality of cloth to be obtained.

As a result of the delay setting, the total downtime of the weaving machine is minimized, so that within the given time interval the weaver himself can choose when to intervene, temporarily stopping the machine if necessary and carrying out the repair.

Finally, it should be noted that the detector 8 can also be formed by one of the turn detectors 32.

The fact that the auxiliary main nozzles 33 and other components are mounted in the path of the weft threads 10 and 11 does not vitiate this invention.

This invention is not limited to the embodiments described by way of example and shown in the figures; on the contrary, such a weaving machine, and more particularly its supply, can be made in various forms while still remaining within the scope of the invention.

I claim:

1. A weft thread supply for an airjet weaving machine, comprising: at least two thread preparation mechanisms, each including task performing means for performing the task of supplying weft thread to the shed of the weaving machine, each said task performing means including at least one thread package, a thread accumulator device, a thread stopping device, and a main nozzle; a detector arranged to detect thread breaks, which operates on at least one of respective thread packages and thread stopping devices; a control unit connected to the detector and to the thread preparation mechanisms and including means for, upon detection of a thread break by the detector, deactivating the thread preparation mechanism in which the thread break has occurred and transferring its task to the other thread preparation mechanism; and a monitoring device connected to the detector, said device including delay circuit means for supplying a delayed output signal for further processing by the control unit after the detector has detected a thread break.

2. A weft thread supply according to claim 1 wherein the delay circuit means is connected to a main drive of the weaving machine, and arranged such that said output signal causes the main drive to be shut off.

3. A weft thread supply according to claim 1 wherein the delay circuit means is connected to an alarm signalling system which is activated at least as soon as said output signal is supplied.

4. A weft thread supply according to claim 1, wherein the monitoring device also includes an alarm signalling system arranged to be activated via a direct connection as soon as said detector detects a thread break.

5. A weft thread supply according to claim 4 wherein said alarm signalling system is arranged to give various signals which are activated progressively as the time interval on the delay circuit means progresses.

6. A weft thread supply according to claim 1 wherein the thread accumulator devices comprise respectively a winding drum and a winding tube, and wherein the detector is mounted at an entrance of the winding tube of one of said thread accumulator devices.

7. A weft thread supply according to claim 1, wherein additional detectors are mounted adjacent to downstream ends of the thread preparation mechanisms, said additional detectors being arranged to shut off a main drive of the weaving machine upon detecting the absence of a weft thread at said downstream ends of the mechanisms.

8. A weft thread supply according to claim 7 wherein said detector is mounted adjacent to an outlet of the main nozzle of each of said thread preparation mechanisms.

* * * * *